US006481871B2

(12) United States Patent
Jamison

(10) Patent No.: US 6,481,871 B2
(45) Date of Patent: Nov. 19, 2002

(54) ADJUSTABLE LAMP SUPPORT

(75) Inventor: William H. Jamison, Covington, VA (US)

(73) Assignee: Hubbell Incorporated, Orange, CT (US)

( * ) Notice: Subject to any disclaimer, the term of this patent is extended or adjusted under 35 U.S.C. 154(b) by 8 days.

(21) Appl. No.: 09/754,249

(22) Filed: Jan. 5, 2001

(65) Prior Publication Data

US 2002/0089851 A1 Jul. 11, 2002

(51) Int. Cl.[7] ..... F21S 13/02
(52) U.S. Cl. ..... 362/287; 362/427; 362/432
(58) Field of Search ..... 362/147, 269, 362/275, 285, 287, 418, 419, 427, 404, 432

(56) References Cited

U.S. PATENT DOCUMENTS

| | | | | |
|---|---|---|---|---|
| 1,090,853 A | | 3/1914 | Holinka | |
| 1,678,366 A | | 7/1928 | Tann | |
| 2,689,909 A | * | 9/1954 | Dazley | 362/287 |
| 2,859,333 A | | 11/1958 | Burliuk et al. | |
| 2,954,771 A | | 10/1960 | Boyan | |
| 3,381,123 A | | 4/1968 | Docimo | |
| 3,660,651 A | | 5/1972 | Miles, Jr. | |
| 4,336,575 A | | 6/1982 | Gilman | |
| 4,380,792 A | | 4/1983 | Terrell | |
| 4,673,149 A | | 6/1987 | Grote et al. | |
| 4,712,168 A | | 12/1987 | Scherrer | |
| 4,727,460 A | * | 2/1988 | Payne | 362/275 |
| 4,729,080 A | | 3/1988 | Fremont et al. | |
| 5,065,297 A | | 11/1991 | Santambrogio et al. | |
| 5,124,901 A | | 6/1992 | Sojka et al. | |
| 5,548,499 A | | 8/1996 | Zadeh | |
| 5,630,663 A | | 5/1997 | Ling et al. | |
| 5,788,518 A | * | 8/1998 | Wachter et al. | 362/287 |
| 5,803,585 A | | 9/1998 | Littman et al. | |
| 5,823,664 A | | 10/1998 | Demshki, Jr. et al. | |
| 5,957,574 A | | 9/1999 | Hentz et al. | |
| 6,036,337 A | | 3/2000 | Belfer | |

* cited by examiner

*Primary Examiner*—Y. My Quach-Lee
(74) *Attorney, Agent, or Firm*—Mark S. Bicks; Tara L. Hoffman; Alfred N. Goodman

(57) ABSTRACT

A lamp support includes a support surface and a main bracket member. The main bracket member includes first and second opposing ends that define a length of the main bracket member, and an elongated aperture extending between the first and second ends. A lamp holder is coupled to the main bracket member adjacent its second end and spaced from its first end. A fastener member is slidably received in the elongated aperture of the main bracket member and releasably couples the support surface and the main bracket member at a coupling axis. The main bracket member slides with respect to the fastener member and the coupling axis along the elongated aperture moving the lamp holder radially relative to the coupling axis, and rotates with respect to the fastener member about the coupling axis moving the lamp holder circumferentially relative to the coupling axis.

27 Claims, 4 Drawing Sheets

ADJUSTABLE LAMP SUPPORT

FIELD OF THE INVENTION

The present invention generally relates to an adjustable lamp support that allows three degrees of adjustment of a lamp supported thereon. More specifically, the present invention relates to a lamp support for a lighting fixture which includes a main bracket with a lamp socket thereon. The bracket is coupled to the lighting fixture for circumferential rotation and radial sliding with respect to the lighting fixture, thereby providing a plurality of orientations for the lamp received in the lamp holder.

BACKGROUND OF THE INVENTION

Conventional lighting fixtures, such as recessed, track, emergency, industrial, or outdoor lighting fixtures, employ a variety of lamp supports for receiving the lamp of the fixture. Adjustment of lamp position is often needed when mounting a lighting fixture on an irregular structure, such as a sloped ceiling, or in an unusual place, such as a corner or the floor. Also, adjustment of the lamp position of the fixture allows the installer to direct the light in a desired direction.

However, typical lamp supports either do not allow any adjustment of the position of the lamp, or provide only one or two degrees of adjustment, such as vertical or horizontal adjustment. In addition, conventional lamp supports include multiple parts thereby increasing manufacturing costs and making operation or adjustment of the support difficult.

Examples of conventional lighting fixtures with lamp supports are disclosed in U.S. Pat. No. 5,823,664 to Demshki, Jr. et al.; U.S. Pat. No. 4,380,792 to Terrell; and U.S. Pat. No. 5,630,663 to Ling et al.

SUMMARY OF THE INVENTION

Accordingly, an object of the present invention is to provide a lamp support for a lighting fixture that provides three degrees of adjustment for the lamp of the fixture thereby facilitating installation of the light.

Another object of the present invention is to provide a lamp support for a lighting fixture that requires a single part for providing adjustment of the lamp, thereby reducing manufacturing expenses and facilitating easy adjustment of the support.

Yet another object of the present invention is to provide a lamp support for a lighting fixture that can be employed with a wide variety of known lighting fixtures.

The foregoing objects are basically attained by a lamp support, comprising a support surface, a main bracket member including first and second opposing ends defining a length of the main bracket member therebetween, and an elongated aperture extending between the first end and the second end and substantially the length of the main bracket member. A lamp holder is coupled to the main bracket member adjacent its second end and is spaced from its first end. A fastener member is slidably received in the elongated aperture of the main bracket member and releasably couples the support surface and the main bracket member at a coupling axis.

By forming the lamp support in this manner, the main bracket member can slide with respect to the fastener member and the coupling axis along the elongated aperture moving the lamp holder radially relative to the coupling axis, and can rotate with respect to the fastener member about the coupling axis moving the lamp holder circumferentially relative to the coupling axis.

The foregoing objects are also basically attained by a lamp support, comprising a support surface, a main bracket member including first and second opposing ends defining a length therebetween, a lamp holder coupled adjacent to the second end and spaced from the first end, and an aperture in the main bracket member. The main bracket member is curved, thereby defining a curved path curved about an axis perpendicular to the length of the main bracket member, with the elongated aperture being located along a portion of the curved path. A fastener member is slidably received in the elongated aperture of the main bracket member and releasably couples the support surface and the main bracket member at a coupling axis. The main bracket member can slide with respect to the fastener member and the coupling axis in the aperture, moving the lamp holder radially relative to the coupling axis, and can rotate with respect to the fastener member about the coupling axis moving the lamp holder circumferentially relative to the coupling axis.

Other objects, advantages and salient features of the invention will become apparent from the following detailed description which taken in conjunction with annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 2:
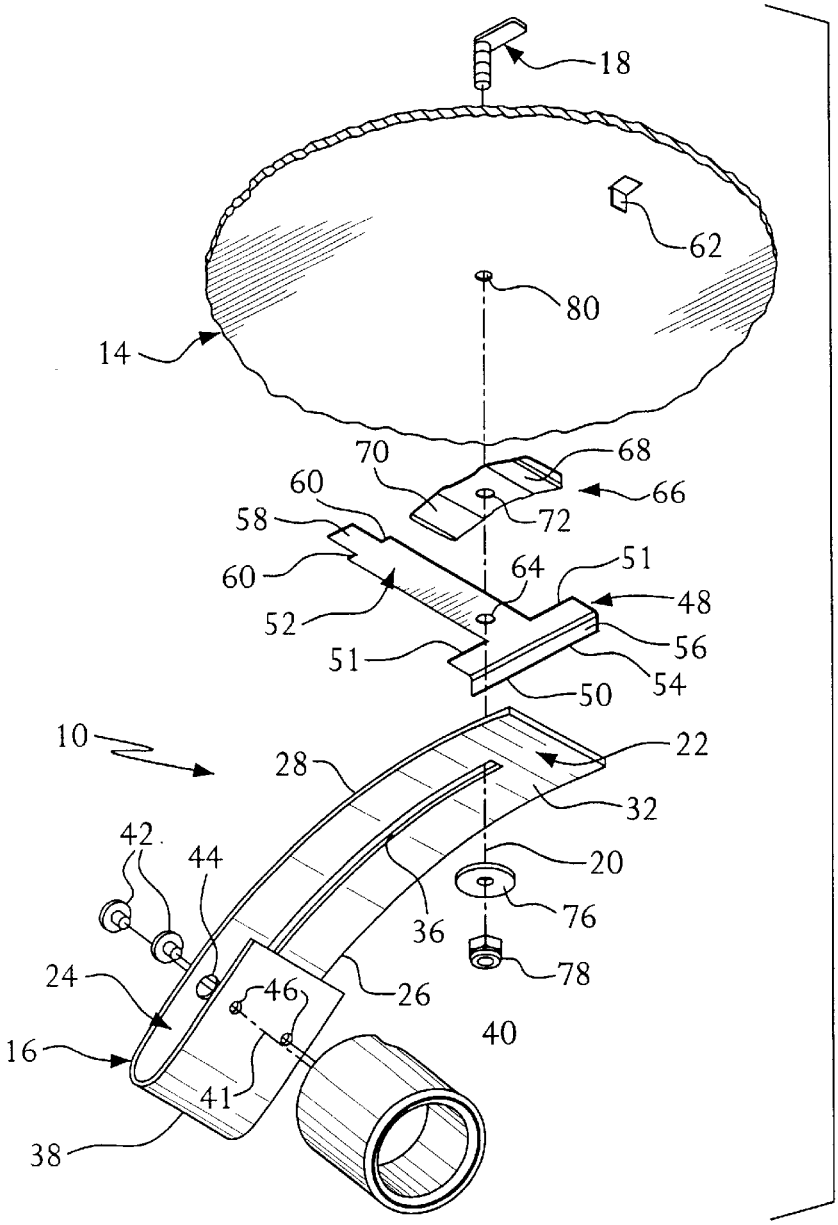
FIG. 2 is an exploded, perspective view of the lamp support illustrated in FIG. 1.
Figure 3:
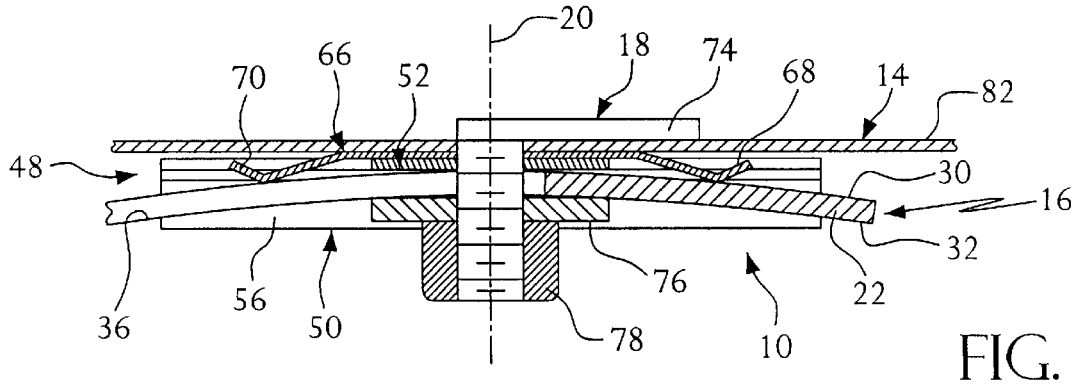
FIG. 3 is an enlarged, side elevational view in section of the lamp support taken along line 3—3 of FIG. 1.
Figure 4:
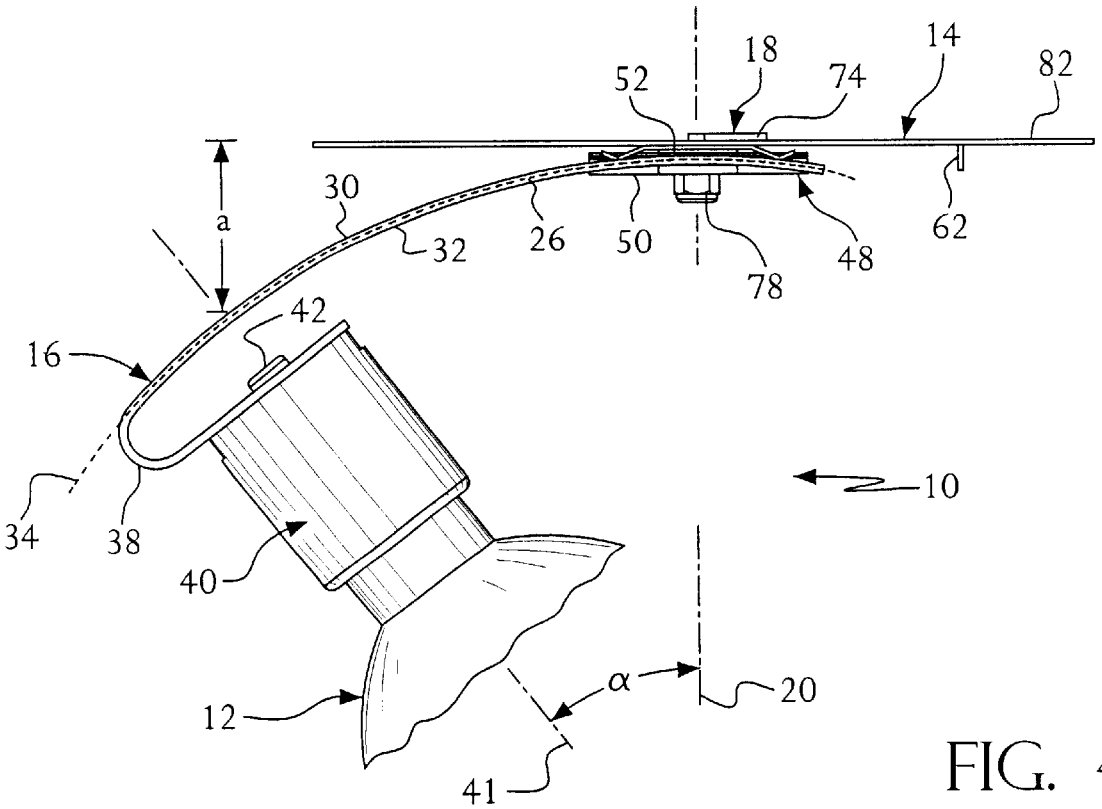
FIG. 4 is a side elevational view of the lamp support illustrated in FIG. 1, showing the support in a first tilt position.
Figure 5:
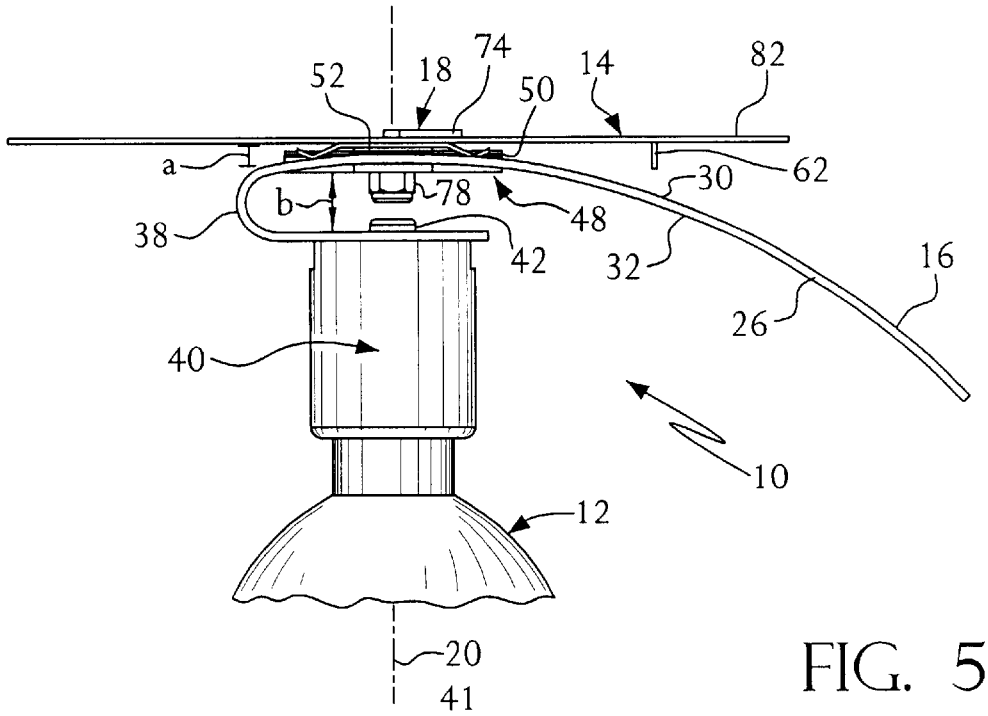
FIG. 5 is a side elevational view of the lamp support illustrated in FIG. 1, showing the support in a second tilt position.
Figure 6:
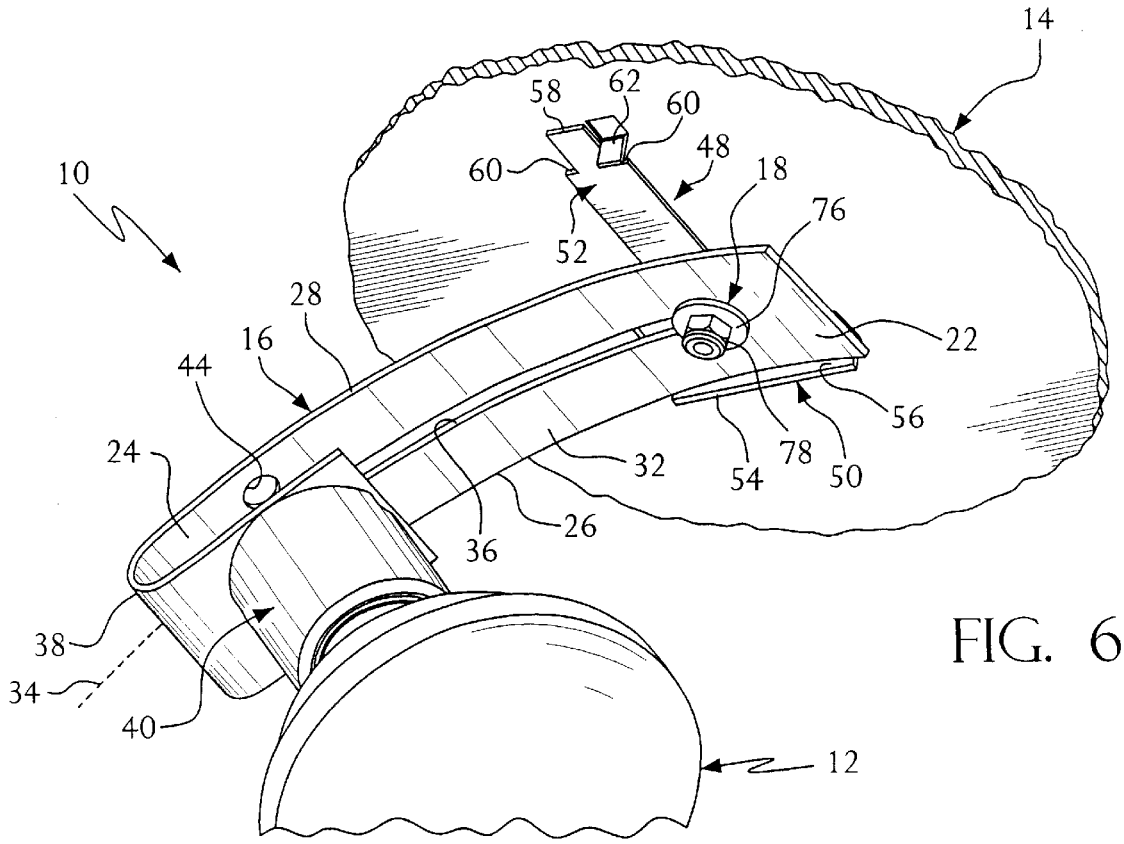
FIG. 6 is a bottom, perspective view of the lamp support illustrated in FIG. 1, showing the support in its first tilt position and a first rotated position.
Figure 7:
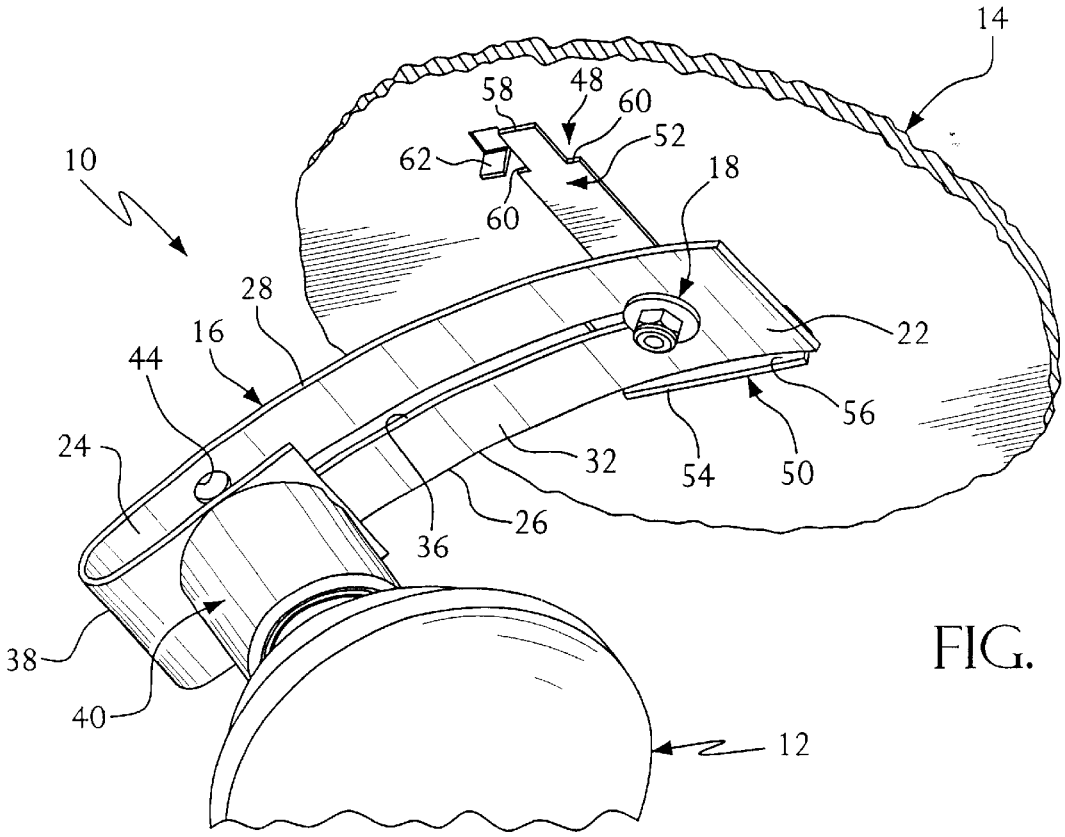
FIG. 7 is a bottom, perspective view of the lamp support illustrated in FIG. 1, showing the support disposed in a second rotated position, a slightly less than 360 degree rotation from its first rotated position.

Referring to FIGS. 1–7, a lamp support 10 in accordance with an embodiment of the present invention receives a lamp 12 and is mounted on a bearing or support surface 14. Lamp support 10 generally includes a main bracket member 16 releasably coupled to bearing surface 14 by a fastener member 18 at a coupling axis 20 so that bracket member 16 can both slide and rotate with respect to coupling axis 20. Sliding bracket member 16 moves bracket member 16 radially relative to coupling axis 20, thereby varying the spacing and angular orientation between bearing surface 14 and bracket member 16 as it slides between first and second tilt positions, as best seen in FIGS. 4 and 5, respectively. Rotating bracket member 16 moves bracket member 16 circumferentially relative to coupling axis 20, from a first rotated position, about 0 degrees, to a second rotated position, slightly less than 360 degrees, as best seen in FIGS. 6 and 7, respectively.

Bearing surface 14 is preferably a surface of a lighting fixture, such as any inside surface of a downlight well known in the art. However, the bearing surface 14 can be any surface of any conventional lighting apparatus such as, downlights, track lighting, emergency lighting, industrial lighting, incandescent or fluorescent light fixtures, and outdoor lighting, where a lamp requires support. Both of the components of lamp support 10 and bearing surface 14 are preferably formed of a metal material.

Main bracket member 16 includes first and second opposing ends 22 and 24 defining the length of bracket member 16 therebetween, and first and second opposing sides 26 and 28 extending between ends 22 and 24. Bracket member 16 is generally elongated and curved about an axis extending perpendicularly to its length and sides 26 and 28, thereby defining opposing first and second curved surfaces 30 and 32 and a curved path 34 along which the bracket member extends. First and second curved surfaces 30 and 32 are preferably the top and bottom surfaces of bracket member 16, respectively; however, second surface 32 can be the top surface and first surface 30 can be the bottom surface.

An elongated aperture 36 receives fastener member 18, and is centrally disposed between sides 26 and 28 and extends between ends 22 and 24 along curved path 34 of bracket member 16. The space a defined between first surface 30 and bearing surface 14, at given points thereon, varies as bracket member 16 radially slides with respect to fastener member 18 along aperture 36, as best seen in FIG. 4.

Figure 1:
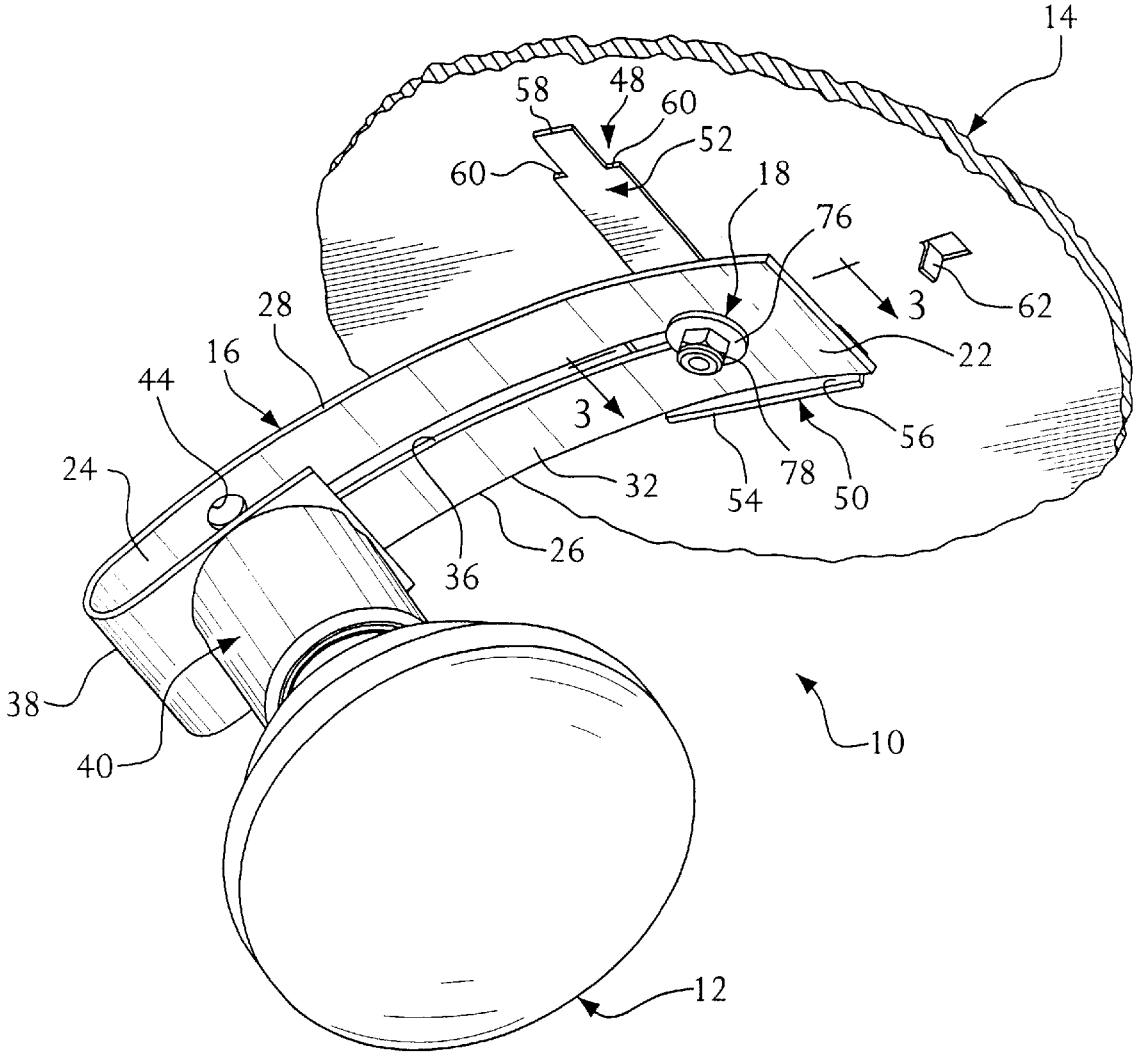
FIG. 1 is a bottom, perspective view of a lamp support in accordance with an embodiment of the present invention, showing a lamp received in a lamp holder of the support.

As seen in FIGS. 1, 4, and 5, a curved extension 38 extends from second end 24 of bracket member 16 forming a U-shaped longitudinal cross section. Curved extension 38 overlaps aperture 36 with the space b, as best seen in FIG. 5, defined between extension 38 and second surface 32 providing clearance for fastener member 18 as bracket member 16 slides.

A lamp holder 40 is supported by curved extension 38 and receives lamp 12 forming a central lamp axis 41, as seen in FIGS. 2 and 4. In particular, fasteners, such as screws 42, extend through access holes 44 in second end 24 of bracket member 16 and attach lamp holder 40 through fastener holes 46. Lamp holder 40 is preferably a socket, but can be any type of lamp holder for various lamps, such as standard light bulbs, incandescent lights, or fluorescent lights.

Preferably, bracket member 16 is a one-piece unitary member. However, it can be formed of separate pieces that are fixedly attached by any known attachment. Also, the curvature of bracket member 16 can vary from that shown, for example, to a more flat or a more curved bracket, depending on the variation of space a, as seen in FIG. 4, desired for positioning lamp 12. In addition, although elongated aperture 36 preferably extends substantially the entire length of bracket member 16, the length of aperture 36 can be either shorter or longer depending on the amount of tilting adjustment desired for lamp 12. Moreover, lamp holder 40 can be supported directly on the second end 24 of bracket member 16, thereby eliminating the need for curved extension 38. However, placing lamp holder 40 at second end 24 would limit the length of aperture 36 since lamp holder 40 would no longer extend over aperture 36.

As seen in FIGS. 1–3, and 5–6, lamp support 10 further includes an anti-rotation stopping bracket 48 disposed between first surface 30 of bracket member 16 and bearing surface 14. Stopping bracket 48 includes first and second portions 50 and 52 forming a generally T-shaped bracket. First portion 50 includes edges 51 facing second portion 52, and an end wall 54 extending perpendicularly from first portion 50 so that stopping bracket 48 has a substantially L-shaped cross-section. End wall 54 includes an abutment surface 56 for engaging either first or second side 26 or 28 of bracket member 16, but preferably first side 26 as seen in FIG. 1.

Second portion 52 of stopping bracket 48 has a distal end 58 forming a shoulder 60 with second portion 52 and engaging a fixed stop extension 62 extending generally, perpendicularly from bearing surface 14, as seen in FIGS. 6 and 7. Opposite distal end 58 and proximate first portion 50 is a fastening hole 64 for receiving fastening member 18, thereby connecting bracket member 16, stopping bracket 48, and bearing surface 14, as best seen in FIG. 3. Although first and second portions 50 and 52 of stopping bracket 48 preferably form a substantially T-shaped bracket, first and second portions 50 and 52 can be the same width so that bracket 48 as one unitary width. In addition, stopping bracket 48 preferably is a unitary one-piece member. However, it can be formed by separate portions that are fixedly attached.

Between bearing surface 14 and stopping bracket 48 is biasing member or spring 66, as best seen in FIGS. 2 and 3. Spring 66 is a metal spring washer with first and second arms 68 and 70 and a fastening hole 72 that receives fastener member 18, connecting bracket member 16, stopping bracket 48, spring 66, and bearing surface 14.

Fastener member 18 is a threaded bolt or screw and includes a portion 74 that is preferably welded to surface 82 of bearing surface 14, thereby restraining rotation relative to surface 14. Tightening washer 76 and nut 78, fastener member 18 sandwiches spring 66 and stopping bracket 48 between bearing surface 14 and bracket member 16, with arms 68 and 70 of spring 66 engaging first surface 30 of bracket member 16. Portion 74 can alternatively act as gripping portion for tightening fastener member 18. Although fastener member 18 preferably is a screw or threaded bolt, any known fastener can be employed that will releasably couple the components of lamp holder 10.

Assembly

Referring to FIGS. 1–3, lamp support 10 is mounted to bearing surface 14 by placing spring 66 and stopping bracket 48 between bearing surface 14 and bracket member 16. Fastening hole 72 of spring 66, fastening hole 64 of stopping bracket 48, elongated aperture 36 of bracket member 16, are then aligned with a fastening hole 80 of bearing surface 14, so that fastener member 18 can be inserted through fastening holes 64, 72, and 80, and aperture 36. Portion 74 abuts, and is preferably welded to surface 82 opposite bearing surface 14. When fastener member 18 has been substantially inserted through bearing surface 14 and the components of lamp support 10, bearing surface 14, spring 66, stopping bracket 48, and bracket member 16, are compressed together by tightening fastener member 18 using nut 78. Tightening nut 78 increases the frictional engagement for retaining bracket member 16 in the desired position. Second portion 52 of stopping bracket 48 is positioned substantially perpendicularly to the length of bracket member 16 for engaging stop extension 62 of bearing surface 14. However, second portion 52 can be oriented in any manner with respect to the bracket member 16, as long as second portion 52 can engage stop extension 62 when rotating bracket member 16.

Upon tightening fastener member 18, first and second arms 68 and 70 of spring 66 engage and push on first surface 30 of bracket member 16, thereby providing a frictional engagement therebetween to maintain bracket member 16 in position. Arms 68 and 70 also engage edges 51 of stopping bracket 48, so that spring 66 rotates with bracket member 16 and stopping bracket 48. Lamp holder 40 can be attached to curved extension 38 of bracket member 16 by inserting screws 42 through access holes 44 and fastener holes 46 of extension 38 and into lamp holder 40, either before or after bracket member 16, stopping bracket 48 and spring 66, are mounted to bearing surface 14. Lamp 12 can then be inserted into lamp holder 40.

Operation

Referring to FIGS. 4–7, by moving only bracket member 16, lamp support 10 provides three degrees of adjustment of the position of lamp 12. For example, main bracket member 16 can radially slide between a first tilt position, shown in FIG. 4, and a second tilt position, shown in FIG. 5, and any position therebetween along curved path 34, by moving bracket member 16 with enough force to overcome the frictional engagement between spring 66 and first surface 30 of bracket member 16. As the bracket member 16 slides between the tilt positions, fastener member 18 slides along elongated aperture 36. At the first tilt position, space a is at its maximum dimension, such as approximately 1.5 inches, and decreases as bracket member 16 slides to the second tilt position where space a is at it minimum dimension, such as approximately 0.2 inches.

Also, at the first tilt position, an angle $\alpha$ defined between coupling axis 20 and lamp axis 41 is at its maximum dimension of approximately 40 to 45 degrees. Upon sliding bracket member 18 toward the second tilt position, angle $\alpha$ decreases, until lamp and coupling axis 41 and 20 become aligned so that angle $\alpha$ is approximately zero degrees. Therefore, by sliding bracket member 16 along elongated aperture 36, the orientation of lamp 12 received in lamp support 10 can be adjusted spatially and angularly by selecting a desired space a and a desired angle $\alpha$.

Main bracket member 16 also rotates from the first rotated position of about 0 degrees where one side of shoulder 60 engages extension 62, as seen in FIG. 6, to the second rotated position of about 360 degrees where another opposing side of shoulder 60 engages extension 62, as seen in FIG. 7. The bracket member 16 can be retained in any rotated position between the first and second rotated positions. This is accomplished by pivoting bracket member 16 around coupling axis 20 with enough force to overcome the frictional engagement between bracket member 16 and spring 66. Upon rotation of bracket member 16, side 26 abuts surface 56 of stopping bracket 48, and edges 51 of bracket 48 abut arms 68 and 70 of spring 66, so that bracket member 16, stopping bracket 48, and spring 66 all rotate together. Thus, in addition to selecting the spatial and angular orientation of lamp holder 10, as described above, lamp holder 10 essentially can be rotated 360 degrees to a desired rotated location, thereby providing the operator with three degrees of adjustment for lamp holder 10.

Changing the curvature of bracket member 16, for example, to a more flat or a more curved bracket, will vary the space a between bracket member 16 and bearing surface 14, as well as the angular orientation of lamp holder 10 desired for positioning lamp 12 defined by angle $\alpha$. In addition, making aperture 36 either longer or shorter will either increase or decrease the amount of tilt of lamp holder 10, since aperture 36 defines the radial travel path for bracket member 16.

While a particular embodiment has been chosen to illustrate the invention, it will be understood by those skilled in the art that various changes and modifications can be made therein without departing from the scope of the invention as defined in the appended claims.

What is claimed is:

1. A lamp support, comprising:

a support surface;

a main bracket member including first and second opposing ends defining a length of said main bracket member therebetween, an elongated aperture extending between said first end and said second end and substantially the length of said main bracket member, said second end of said main bracket member including a curved extension;

a lamp holder coupled to said main bracket member adjacent said second end thereof and spaced from said first end thereof said curved extension of said second end supporting said lamp holder along an axis substantially radial to said elongated aperture; and a fastener member slidably received in said elongated aperture of said main bracket member and releasably coupling said support surface and said main bracket member at a coupling axis;

whereby said main bracket member can slide with respect to said fastener member and said coupling axis along said elongated aperture moving said lamp holder radially relative to said coupling axis, and can rotate with respect to said fastener member about said coupling axis moving said lamp holder circumferentially relative to said coupling axis.

2. A lamp support according to claim 1, wherein said main bracket member is curved defining a curved path about an axis perpendicular to the length of said main bracket member; and said elongated aperture extends along said curved path;

whereby sliding said main bracket member relative to said fastener member varies spacing and angular orientation between said support surface and said lamp holder.

3. A lamp support according to claim 1, wherein said curved extension is substantially U-shaped in cross-section.

4. A lamp support according to claim 1, wherein said main bracket member includes first and second opposing surfaces, said first surface of said bracket member generally facing said support surface; and said lamp holder extends in a direction away from said second surface.

5. A lamp support according to claim 4, wherein when said fastener member is positioned in said elongated aperture proximate said first end of said main bracket member, said first surface of said main bracket member at said first end is spaced closer to said support surface than said first surface at said second end.

6. A lamp support according to claim 5, wherein when said fastener member is positioned in said elongated aperture proximate said second end of said main bracket member, said first surface of said main bracket member at said first end is spaced further from said support surface than said first surface at said second end.

7. A lamp support according to claim 6, wherein said main bracket member can rotate substantially up to 360 degrees.

8. A lamp support according to claim 7, wherein said support surface includes a fixed stop extension; and a stopping bracket member is disposed between said main bracket member and said support surface, said stopping bracket having a first portion rotationally fixed to said main bracket member and a second portion for engaging said stop extension.

9. A lamp support according to claim 8, wherein said first portion is an end wall that abuts a side of said main bracket member; and said end wall is substantially perpendicular to said second end portion.

10. A lamp support according to claim 9, wherein a biasing member is disposed between said main bracket member and said support surface to maintain said main bracket member in position.

11. A lamp support according to claim 1, wherein said main bracket member is a one piece, unitary member.

12. A lamp support according to claim 1, wherein said lamp holder is a socket; and a lamp is received in said socket.

13. A lamp support, comprising:

a support surface;

a main bracket member including first and second opposing ends defining a length therebetween, with a lamp holder coupled adjacent to said second end and spaced from said first end and an aperture disposed therein, said main bracket member being curved, thereby defining a curved path about an axis perpendicular to the length of said main bracket member, said elongated aperture being located along a portion of said curved path, and said second end of said main bracket member including a curved extension for supporting said lamp holder over said elongated aperture in a radially spaced relationship; and a fastener member slidably received in said elongated aperture of said main bracket member and releasably coupling said support surface and said main bracket member at a coupling axis, sliding said main bracket member relative to said fastener member varying spacing and angular orientation between said support surface and said lamp holder;

whereby said main bracket member can slide with respect to said fastener member and said coupling axis in said aperture moving said lamp holder radially relative to said coupling axis and can rotate with respect to said fastener member about said coupling axis moving said lamp holder circumferentially relative to said coupling axis.

14. A lamp support according to claim 13, wherein said aperture in said main bracket member is elongated and extends between said first and second ends.

15. A lamp support according to claim 13, wherein said support surface includes a fixed stop extension; and a stopping bracket member is disposed between said main bracket member and said support surface, said stopping bracket having a first portion rotationally fixed to said main bracket member and a second portion for engaging said stop extension.

16. A lamp support according to claim 14, wherein said main bracket member can rotate up to substantially 360 degrees.

17. A lamp support, comprising:

a support surface having a fixed stop extension;

a main bracket member including first and second opposing ends defining a length therebetween, a lamp holder coupled to said second end and spaced from said first end, and an elongated aperture extending proximate said first end to proximate said second end, said main bracket member being curved defining a curved path about an axis perpendicular to the length of said main bracket member, said elongated aperture extending along said curved path;

a stopping bracket member disposed between said main bracket member and said support surface, and having a first portion rotationally fixed to said main bracket member and a second portion engagable with said stop extension of said support surface;

a biasing member disposed between said support surface and said stopping bracket member;

a fastener member slidably received in said elongated aperture of said main bracket member and in fastener openings in said support surface, stopping bracket member, and said biasing member, respectively, releasably coupling said support surface, said main bracket member, said stopping bracket member and said biasing member at a coupling axis; and a lamp received in said holder member, whereby said main bracket member slides with respect to said fastener member and said coupling axis along said elongated aperture moving said lamp holder radially relative to said coupling axis, and rotates with respect to said fastener member about said coupling axis, moving said lamp holder circumferentially relative to said coupling axis.

18. A lamp support according to claim 17, wherein said main bracket member is a unitary one-piece member; and sliding said main bracket member relative to said fastener member varies spacing and angular orientation between said support surface and said lamp holder.

19. A lamp support according to claim 18, wherein said main bracket member can rotate up to substantially 360 degrees.

20. A lamp support according to claim 19, wherein said lamp holder is a socket.

21. A lamp support, comprising:

a support surface;

a main bracket member including first and second opposing ends defining a length of said main bracket member therebetween, an elongated aperture extending between said first end and said second end and substantially the length of said main bracket member, said main bracket member including first and second opposing surfaces, said first surface of said bracket member generally facing said support surface;

a lamp holder coupled to said main bracket member adjacent said second end thereof and spaced from said first end thereof, said lamp holder extending in a direction away from said second surface; and a fastener member slidably received in said elongated aperture of said main bracket member and releasably coupling said support surface and said main bracket member at a coupling axis, said first surface of said main bracket member at said first end being spaced closer to said support surface than said first surface at said second end when said fastener member is positioned in said elongated aperture proximate said first end of said main bracket member;

whereby said main bracket member can slide with respect to said fastener member and said coupling axis along said elongated aperture moving said lamp holder radially relative to said coupling axis, and can rotate with respect to said fastener member about said coupling axis moving said lamp holder circumferentially relative to said coupling axis.

22. A lamp support according to claim 21, wherein when said fastener member is positioned in said elongated aperture proximate said second end of said main bracket member, said first surface of said main bracket member at said first end is spaced further from said support surface than said first surface at said second end.

23. A lamp support according to claim 22, wherein said main bracket member can rotate substantially up to 360 degrees.

24. A lamp support according to claim 23, wherein said support surface includes a fixed stop extension; and a stopping bracket member is disposed between said main bracket member and said support surface, said stopping bracket having a first portion rotationally fixed to said main bracket member and a second portion for engaging said stop extension.

25. A lamp support according to claim 24, wherein said first portion is an end wall that abuts a side of said main bracket member; and said end wall is substantially perpendicular to said second end portion.

26. A lamp support according to claim 25, wherein a biasing member is disposed between said main bracket member and said support surface to maintain said main bracket member in position.

27. A lamp support, comprising:

a support surface including a fixed stop extension;

a main bracket member including first and second opposing ends defining a length therebetween, with a lamp holder coupled adjacent to said second end and spaced from said first end and an aperture disposed therein, said main bracket member being curved, thereby defining a curved path about an axis perpendicular to the length of said main bracket member, said elongated aperture being located along a portion of said curved path; and a stopping bracket member disposed between said main bracket member and said support surface, said stopping bracket having a first portion rotationally fixed to said main bracket member and a second portion for engaging said stop extension; and a fastener member slidably received in said elongated aperture of said main bracket member and releasably coupling said support surface and said main bracket member at a coupling axis;

whereby said main bracket member can slide with respect to said fastener member and said coupling axis in said aperture moving said lamp holder radially relative to said coupling axis and can rotate with respect to said fastener member about said coupling axis moving said lamp holder circumferentially relative to said coupling axis.

* * * * *